US006386437B1

(12) United States Patent
Larson, Jr.

(10) Patent No.: US 6,386,437 B1
(45) Date of Patent: May 14, 2002

(54) CONTAINER WITH AUTOMATICALLY CLOSING BOTTOM STRUCTURE

(75) Inventor: Daniel John Larson, Jr., Visalia, CA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/638,191

(22) Filed: Aug. 14, 2000

(51) Int. Cl.[7] ..... B65D 5/36

(52) U.S. Cl. ..... 229/117; 229/117.01; 229/109; 229/117.06

(58) Field of Search ..... 229/109, 117.06, 229/117, 117.01

(56) References Cited

U.S. PATENT DOCUMENTS

| | | | | |
|---|---|---|---|---|
| 3,119,547 A | * | 1/1964 | Nute | 229/117.06 X |
| 3,411,692 A | | 11/1968 | Mathews | |
| 3,525,466 A | | 8/1970 | Robinson | |
| 3,549,081 A | * | 12/1970 | Nelson | 229/117 X |
| 4,146,169 A | | 3/1979 | Meyers | |
| 4,199,098 A | * | 4/1980 | Lopez | 229/117 X |
| 4,225,078 A | * | 9/1980 | Croley | 229/109 X |
| 4,289,267 A | | 9/1981 | Mayea | |
| 4,383,637 A | * | 5/1983 | Pfieffer et al. | 229/109 X |
| 4,441,649 A | | 4/1984 | Nederveld | |
| 4,530,460 A | | 7/1985 | Hinton | |
| 4,549,690 A | | 10/1985 | Rosenberg | |
| 4,583,678 A | | 4/1986 | Weimer, Jr. | |
| 4,856,705 A | | 8/1989 | Carr et al. | |
| 4,899,927 A | | 2/1990 | Straub et al. | |
| 4,899,929 A | | 2/1990 | Grollman | |
| 5,042,714 A | * | 8/1991 | Hall | 229/117 |
| 5,139,196 A | * | 8/1992 | Fry et al. | 229/109 X |
| 5,485,951 A | | 1/1996 | Phillips | |
| 5,630,543 A | | 5/1997 | Dugan | |
| 5,816,483 A | | 10/1998 | Gasper | |
| 5,915,617 A | | 6/1999 | Gasper | |
| 5,921,465 A | * | 7/1999 | Garton | 229/109 |
| 6,079,616 A | * | 6/2000 | Chinks et al. | 229/101 |

* cited by examiner

*Primary Examiner*—Allan N. Shoap
*Assistant Examiner*—Tri M. Mai
(74) *Attorney, Agent, or Firm*—Dennis H. Lambert

(57) ABSTRACT

A collapsible octagonal bulk box has a bottom structure that closes automatically when the box is moved from a folded-flat condition to an erected condition. The box has opposed side walls and opposed end walls foldably connected by diagonal corner panels. A pair of diagonally opposite corner panels are bisected by longitudinal fold lines, and these fold lines define the outer edges of the folded-flat box. A major bottom flap is foldably connected to the bottom edge of each side wall, and a minor bottom flap is foldably connected to the bottom edge of each end wall. Each major bottom flap has a lateral side extension on its opposite side edges, and a diagonal fold line extends across one extension on each flap to define a triangular portion on each flap. The triangular portions are adhesively attached to an adjacent minor bottom flap, and in the folded-flat condition of the box the flaps project outwardly of the box.

5 Claims, 6 Drawing Sheets

CONTAINER WITH AUTOMATICALLY CLOSING BOTTOM STRUCTURE

BACKGROUND OF THE INVENTION

1. Field of the Invention

This invention relates to containers. More particularly, the invention relates to a container that has an automatically operating bottom structure that moves into a closed position as the box is opened from a folded-flat condition to an erected or expanded condition.

2. Prior Art

Bulk containers made of various materials and in a variety of shapes are used for the shipment and storage of many products, including nuts, meats, produce, resins and other goods. Corrugated cardboard containers, in particular, are popular because of their relatively low cost, light weight and recyclability. Among these, bulk boxes having an octagonal cross-section are in widespread use because of their strength and other desirable attributes.

Corrugated cardboard bulk containers can be shipped in a folded-flat or knocked-down condition and erected into their expanded or opened box shape at the point of use, thereby minimizing shipping and storage costs. However, many of these designs are difficult to manipulate from their flattened condition to their erected condition, and may even require the labor of more than one person to erect.

Some corrugated bulk containers have been designed to facilitate erection of them from a folded-flat condition to their erected, open box shape. These designs include containers with automatically operating bottom structures that automatically close as the box is moved from a folded-flat condition to an erected condition, as exemplified in U.S. Pat. Nos. 3,525,466, 4,530,460 and 4,856,705. The container in U.S. Pat. No. 3,525,466 has six sides, and a bridging panel extending across its bottom, formed by adhesively attached panels 26 and 28 extending inwardly across the bottom from respective opposite side walls. The container in U.S. Pat. No. 4,530,460 has four sides, and the bottom closure-forming flaps are folded or tucked inwardly into the box in its folded-flat condition. U.S. Pat. No. 4,856,705 has eight sides, forming an octagonally shaped box, but it also has a bottom bridging panel, formed by panels 65 and 68 extending inwardly across the bottom from respective opposite side walls. Moreover, the four flaps forming the bottom structure in this patent are all tucked inside the box in its folded-flat condition.

Applicant is not aware of any prior octagonal bulk box that may be shipped in a folded-flat condition and erected by a single person at the point of use into an open box shape, wherein the box has an automatically operating bottom closure structure that closes as the box is being moved to its opened or erected condition, and wherein the bottom closure structure is located externally of the box when in its flattened condition, so that it is necessary only to exert force against opposite side edges of the folded-flat box to cause it to move to its opened, erected position and to cause the bottom to move to a closed and locked condition.

SUMMARY OF THE INVENTION

The present invention is a container that may be left in a folded-flat condition until it is ready to be used, and then erected by a single person at the point of use into an open box shape, wherein the box has an automatically operating bottom closure structure that closes as the box is being moved to its opened or erected condition, and wherein the bottom closure structure is located externally of the box when in its flattened condition, so that it is necessary only to exert force against opposite side edges of the folded-flat box to cause it to move to its opened, erected position and to cause the bottom to move to a closed and locked condition.

More specifically, the container of the invention is an octagonal bulk box having two opposed side panels and two opposed end panels, joined at opposite side edges by diagonal corner panels. Two major bottom flaps are foldably joined to opposite side panels, and two minor bottom flaps are foldably joined to opposite end panels. Each major bottom flap has a diagonal fold line defining a generally triangular side portion, and the minor bottom flaps are adhesively secured to adjacent ones of the end portions when adjacent side and end panels are folded into overlying relationship to one another. One pair of diagonally opposed corner panels are bisected by longitudinal fold lines that are coplanar with the diagonal fold lines in the major bottom flaps when the box is folded flat.

When the box is opened up from its folded-flat condition by pressing inwardly on opposite side edges of the folded-flat box, the side and end panels expand outwardly, unfolding along the fold lines joining the side and end panels and the diagonal corner panels, and along the fold line bisecting the pair of opposed corner panels and the diagonal fold lines in the major bottom flaps, whereby the bottom flaps automatically position themselves and engage one another to form a closed bottom. Notches on opposed free edges of the major bottom flaps mutually interengage to lock the bottom closed and hold the box in its erected condition.

The bulk box of the invention is of simple and economical construction, and is easy to use by a single person. It requires a minimum of manipulative steps to move it from its folded-flat condition to its opened erected condition, and may be used in conjunction with a pallet.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENT

Figure 1:
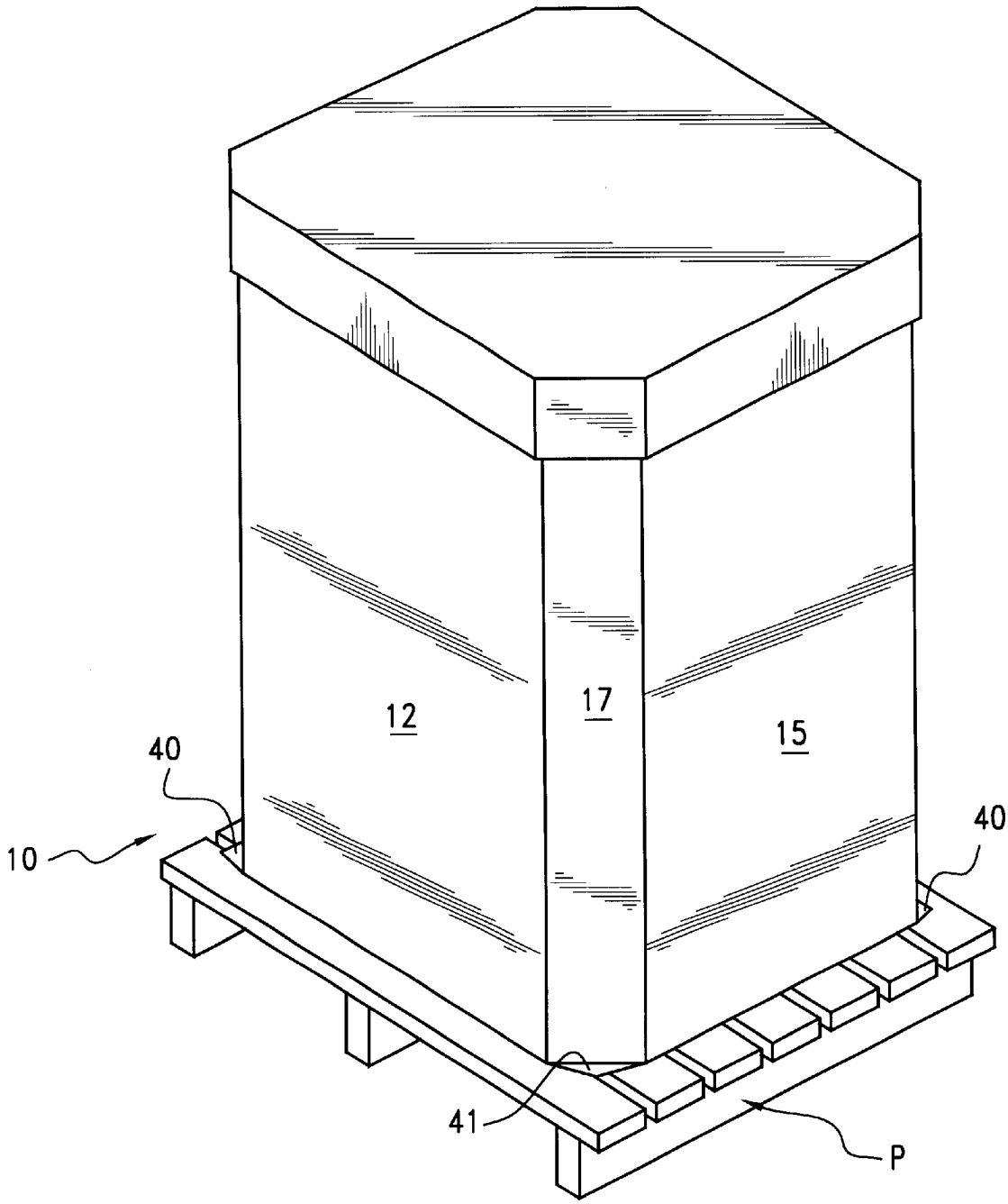
FIG. 1 is a top perspective view of an octagonal bulk box according to the invention, shown on a pallet.

Referring more specifically to the drawings, an octagonal bulk box according to the invention is indicated generally at 10, and is shown in FIG. 1 supported on a pallet P.

Figure 2:
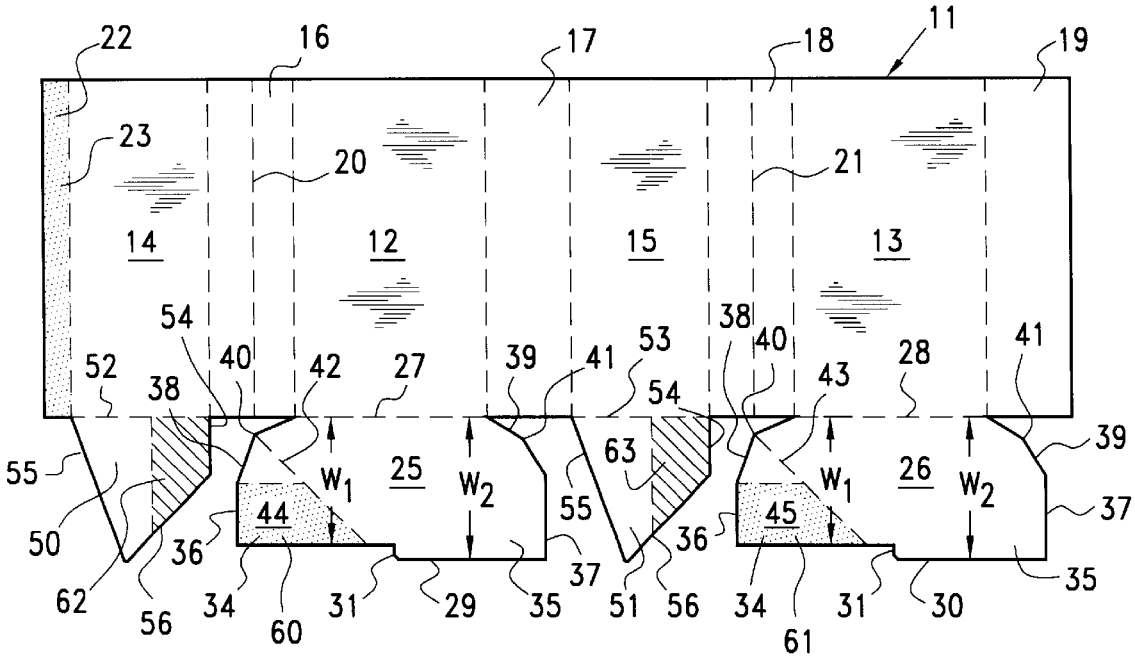
FIG. 2 is a plan view of the single piece blank used to form the bulk box of the invention.
Figure 3:
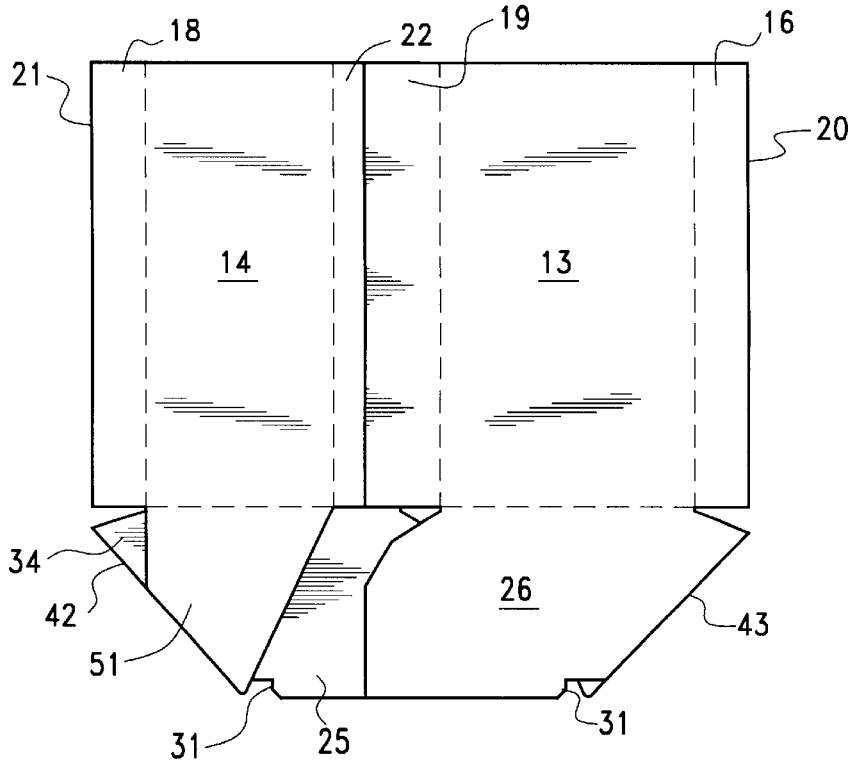
FIG. 3 is a slightly enlarged plan view of the blank of FIG. 2 folded upon itself and secured by adhesive or other fastening means to form the folded-flat box of the invention.

As shown in FIG. 2, the box is constructed from a single blank 11 having a first pair of rectangular panels 12 and 13 that form opposite side panels in the erected box, a second pair of rectangular panels 14 and 15 that form opposite end panels in the erected box, and four relatively narrower panels 16, 17, 18 and 19 that join the side and end panels together and form diagonal corner panels in the erected box. One pair, 16 and 18, of the corner panels are bisected by longitudinal fold lines 20 and 21, respectively. When the box is erected, these corner panels are in diagonally opposed relationship to one another, as seen best in FIGS. 4–7. A narrow glue flap 22 is joined to one side edge of the panel 14, and when the box is folded upon itself during manufacture, as shown in FIG. 3, the glue flap is adhesively secured to the panel 19 at the opposite end of the blank, to hold the blank in the flattened, tubular configuration shown in FIG. 3.

The side of the blank facing upwardly from the plane of the drawing in FIG. 2 can be assumed for the purpose of illustration as comprising the inner surface of the box when completed. Thus, adhesive 23 applied to the upwardly facing surface of the glue flap 22 would be adhered to the back surface of the panel 19, as viewed in FIG. 2, when the blank is folded over onto itself to form the tubular box structure, as shown in FIG. 3.

First and second identically constructed major bottom flaps 25 and 26 are foldably joined to the bottom edges of respective side panels 12 and 13 along fold lines 27 and 28. Each major flap has a free edge 29, 30, respectively, opposite the fold line, with a shoulder or step 31 at approximately the midportion thereof, defining first and second portions of different widths "$w_1$" and "$w_2$" between the respective fold lines and free edges. The width "$w_1$" of the first portion of each flap is equal to approximately one-half the distance between opposite side panels 12 and 13 when the box is erected, and the width "$w_2$" of the second portion is greater, whereby the flaps meet one another at their free edges when they are folded inwardly over the bottom in the erected box, with the shoulders 31 interengaged and the inner margins 32, 33 of the portions of greater width overlapping the edges of the opposite flap.

Further, each major flap has opposite side edge extensions 34 and 35, with respective side edges 36 and 37 thereof extending perpendicular to the fold lines 27 and 28, and angled edges 38 and 39 extending at approximately a 45° angle from inner ends of the edges 36 and 37 to respective opposite ends of the fold lines 27 and 28. The angled edges are shaped to have a point 40, 41, respectively, for a purpose described hereinafter.

A diagonal fold line 42, 43, respectively, extends at a 45° angle across each major flap from the respective point 40 and 41 thereof to the free edge adjacent the shoulder 31, defining generally triangularly shaped portions 44 and 45, respectively, at one side edge of each major flap. It will be noted that the points 40 and 41, and thus the laterally outermost ends of the diagonal fold lines 42 and 43, are in alignment with the respective fold lines 20 and 21 bisecting the corner panels 16 and 18.

A pair of substantially identical minor bottom flaps 50 and 51 are foldably joined to bottom edges of the end panels 14 and 15, respectively, along fold lines 52 and 53. One side edge 54 of each minor flap extends a relatively short distance perpendicular to the respective fold line, and the other side edge 55 of each flap extends substantially farther and at an angle of about 70° to the fold line. The free edge 56 of each flap extends at about a 45° angle between the edges 54 and 55.

Adhesive 23 is applied to the glue flap 22, as noted previously, and to the rear surface, as viewed in FIG. 2, of the triangularly shaped portions 44 and 45 of the major flaps in an area bounded by the respective diagonal fold lines 42, 43, the respective free edges 29, 30, and the respective side edges 36 and 37. The patches of adhesive on the rear surface of the triangular portions of the major flaps would not be visible in FIG. 2, but their locations are indicated by the shaded areas 60 and 61.

Figure 9:
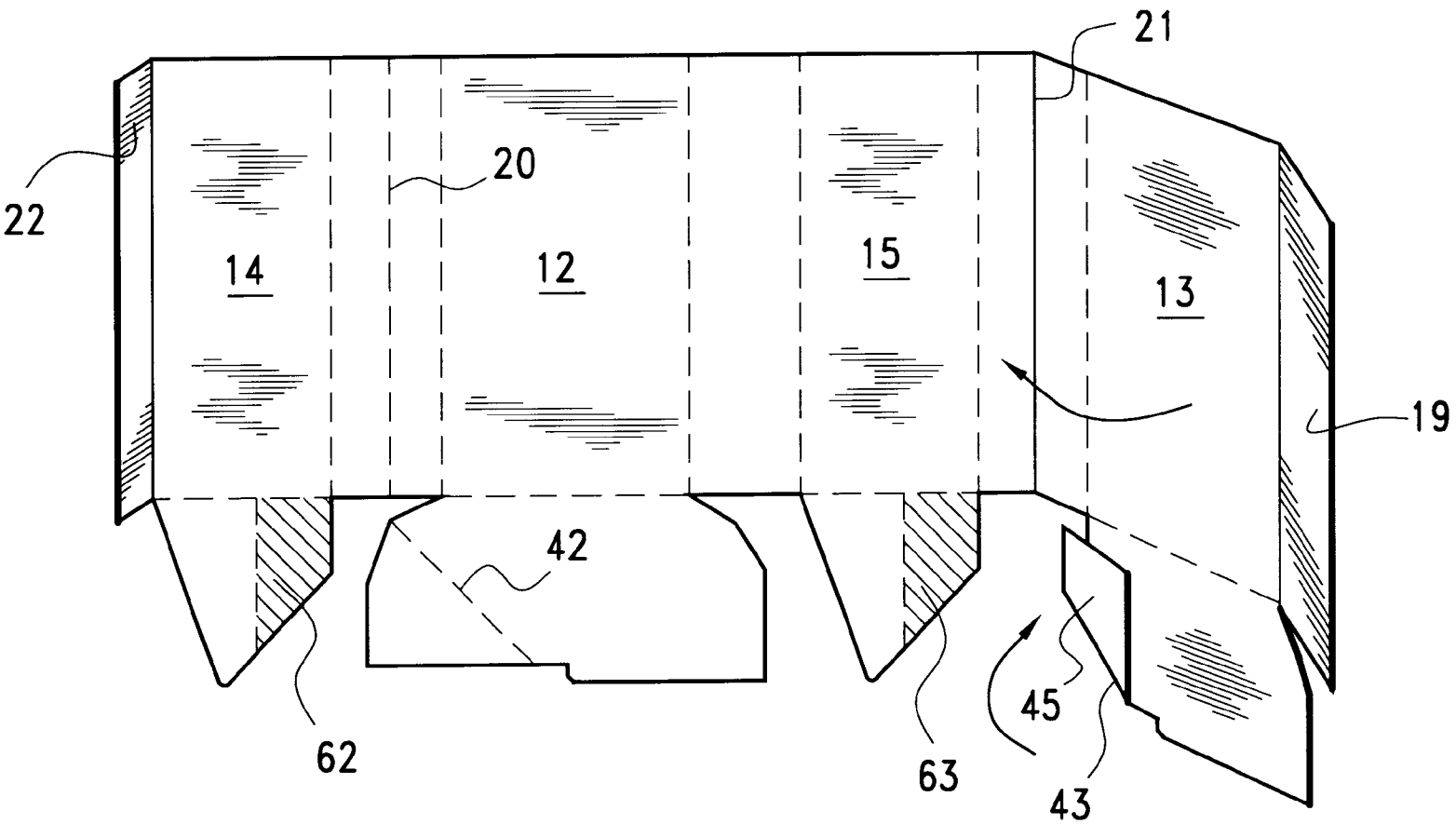
FIGS. 9 and 10 are plan views of the blank of FIG. 2, shown in progressive stages of folding it to form the flattened box of FIG. 3.
Figure 10:
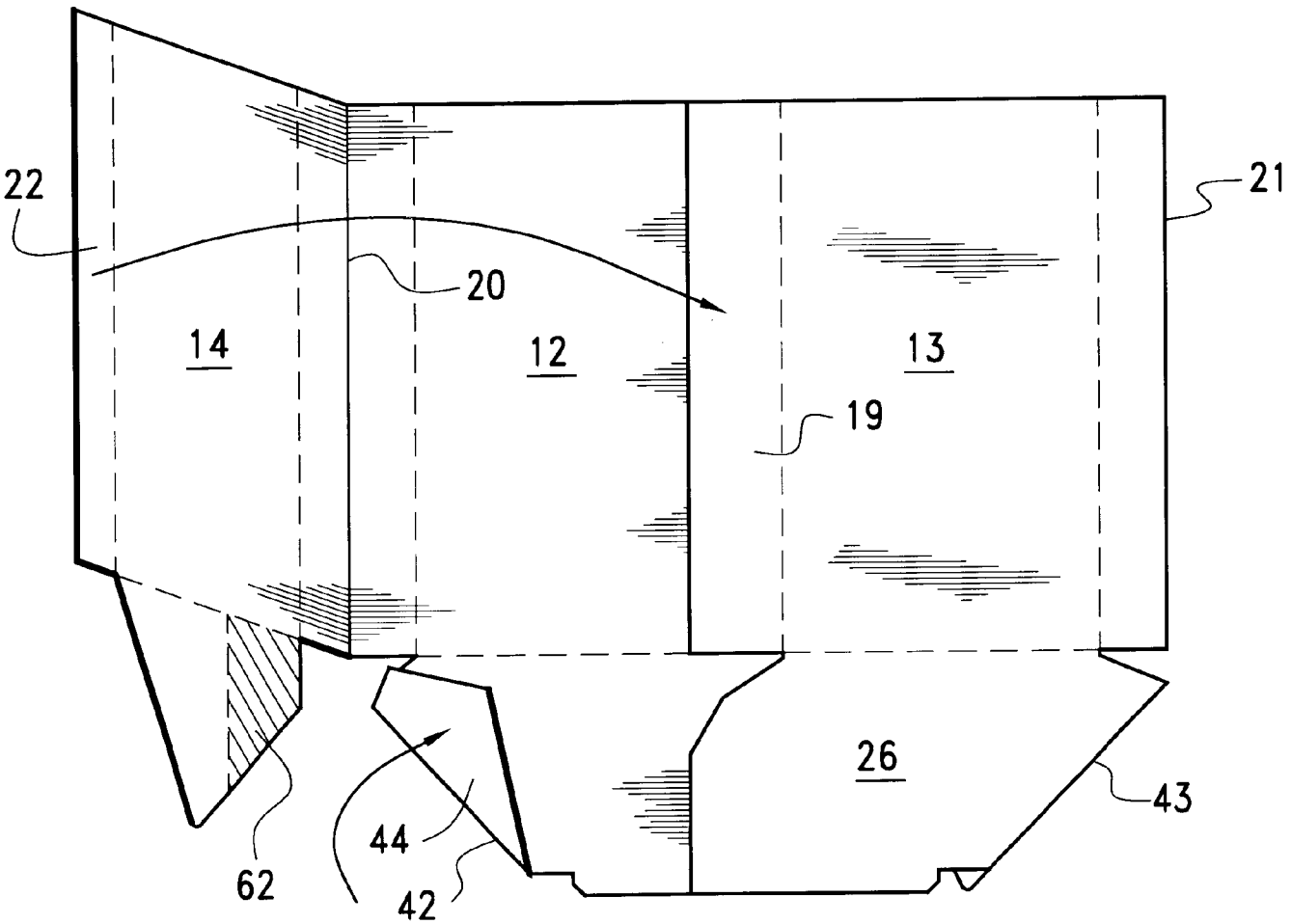

As depicted in FIGS. 9, 10 and 2, the box is assembled by folding the blank upon itself about the fold lines 20 and 21 in the corner panels 16 and 18, and positioning the adhesive 23 on the glue flap 22 against the rear edge portion of the corner panel 19 at the opposite end of the flap, as shown in FIG. 3. Simultaneously, the triangular side portions 44 and 45 of the major flaps are folded upwardly, or inwardly of the box, so that the adhesive areas 60 and 61 on the rear surfaces of the major flaps overlie the shaded areas 62, 63 on the front surface of the minor flaps, whereby the major and minor flaps are adhesively secured together in the areas shaded in FIG. 2. The folded-flat, assembled box then has the shape shown in FIG. 3.

Figure 5:
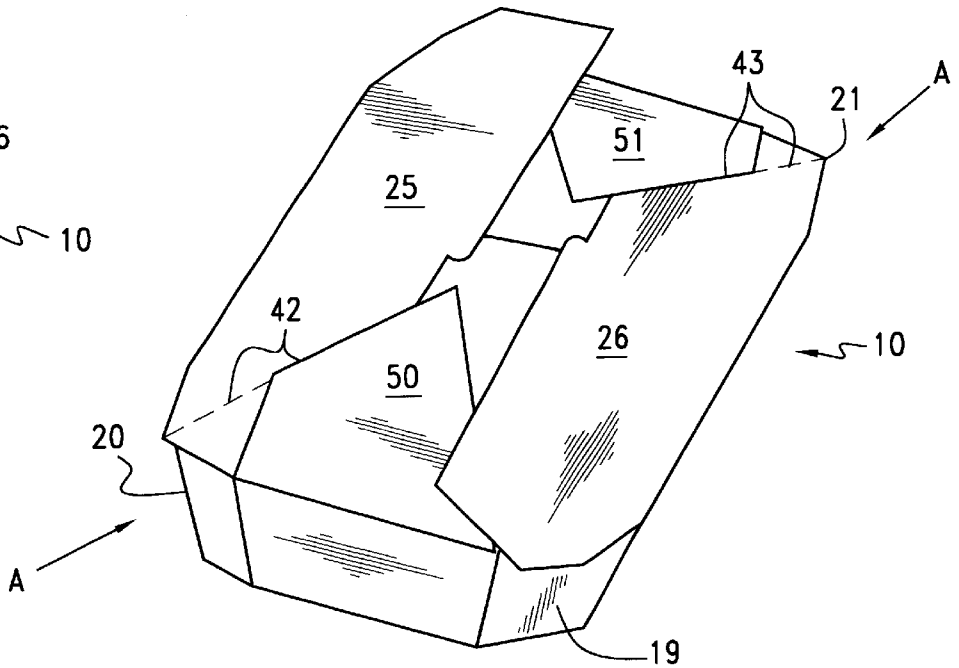
FIG. 5 is a bottom perspective view showing the box moved further into its opened, erected condition.
Figure 4:
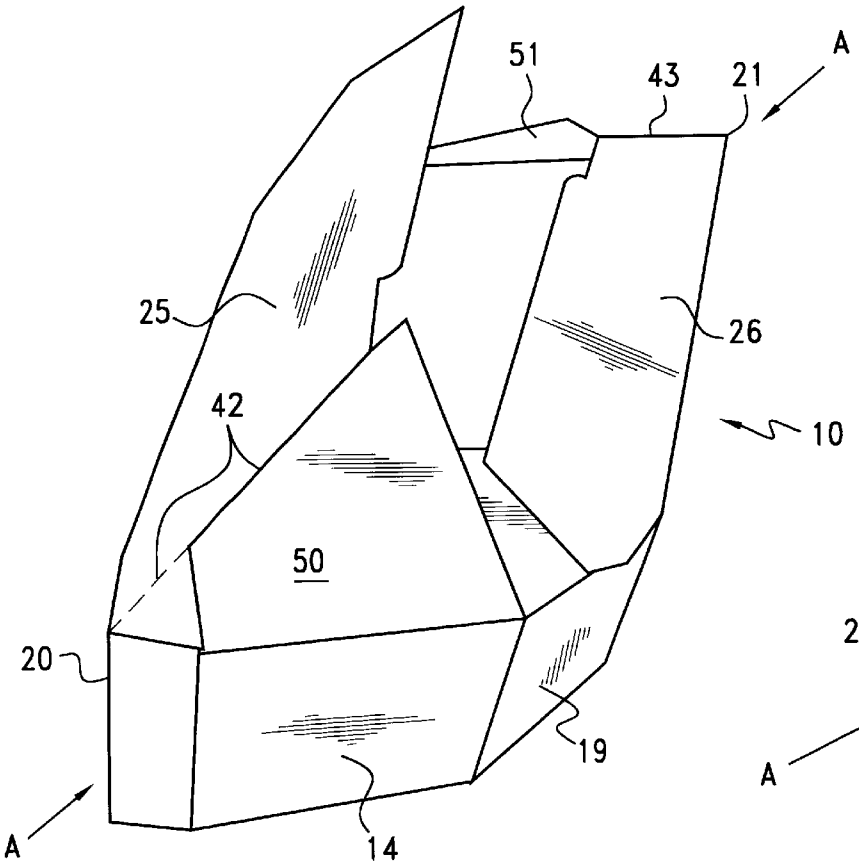
FIG. 4 is a bottom perspective view of the box of FIG. 3, shown partially expanded into its erected condition by exerting pressure on the opposite side edges as indicated by the arrows "A".

At the point of use, it is necessary only to press inwardly against the opposite folded edges of the box, as represented by the arrows "A" in FIGS. 4 and 5, to cause the box to open up or expand. As this is occurring, the bottom flaps automatically move into a closed and locked position as illustrated sequentially in FIGS. 4–7. To facilitate this operation, the box may be inverted to an upside-down orientation as depicted in FIGS. 4–7.

Figure 8:
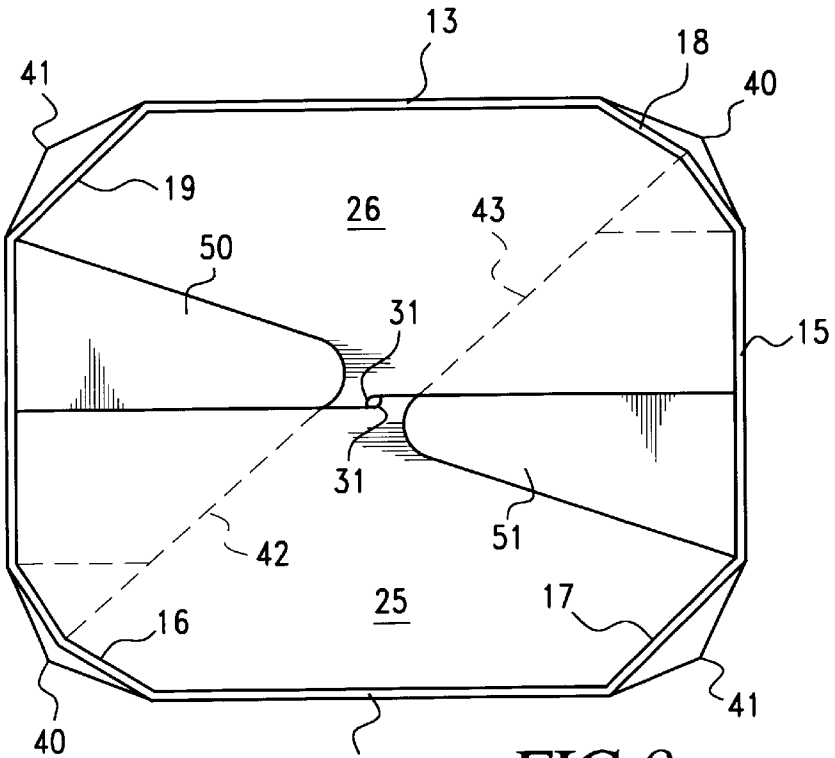
FIG. 8 is a top plan view of the box, showing the inside of the bottom.
Figure 6:
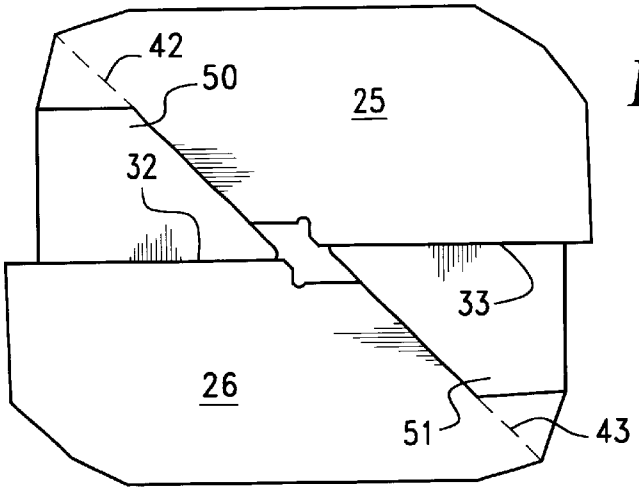
FIG. 6 is a bottom plan view of the box, shown almost in a fully erected condition.
Figure 7:
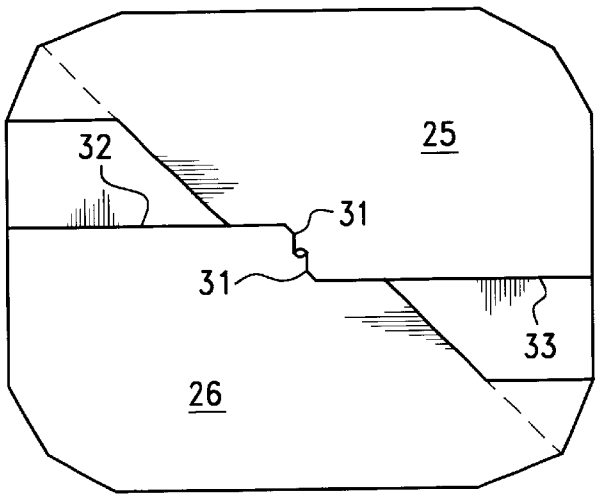
FIG. 7 is a bottom plan view of the box in its fully erected condition, with the bottom flaps in mutually interengaged, locked together relationship.

FIG. 8 shows the relationship of the flaps on the interior surface of the box bottom when the box is fully opened up or erected.

It will be noted that the pointed shapes of the angled side edge portions 38 and 39 of the major bottom flaps form extensions that close any openings that may exist in the area of the bottom in the vicinity of the corner panels, especially at the corner panels 16 and 18 that are bisected by longitudinal fold lines. See FIG. 8.

While particular embodiments of the invention have been illustrated and described in detail herein, it should be understood that various changes and modifications may be made to the invention without departing from the spirit and intent of the invention as defined by the scope of the appended claims.

What is claimed is:

1. A collapsible bulk box that may be shipped in a folded-flat condition and opened into an erected condition by one person at a point of use, said box having a bottom structure that automatically moves to a closed position as the box is erected, comprising:

a single blank scored to define a first pair of rectangular panels that form first and second opposed side walls in a completed box, a second pair of rectangular panels that form first and second opposed end walls in a completed box, and third and fourth rectangular panels that form diagonal corner panels connected between adjacent side and end walls in a completed box, said corner panels being bisected by a longitudinal fold line and foldably connected at opposite side edges thereof to opposite side edges of the side and end walls, and said side and end walls having top and bottom edges and opposite side edges;

a glue panel extending along one side edge of the blank, said blank being folded upon itself along said longitudinal fold lines into a folded-flat condition, and said glue panel adhesively attached to an opposite side edge of the blank to form a flattened tubular structure;

a pair of major bottom flaps foldably joined to the bottom edges of respective side walls along transverse fold lines, each major bottom flap having laterally projecting extensions on opposite side edges thereof and a free edge opposite the edge that is foldably connected to the associated side wall, said free edges on opposite major bottom flaps extending into close proximity to one another when the box is erected, each said free edge having offset portions defining a shoulder, said shoulders being interengaged to lock the major bottom flaps in their closed position when the box is erected, and the side edge of each extension includes, adjacent the free edge of the flap, an outer portion extending parallel to the longitudinal fold line at the side edge of the associated side wall, and an inner portion extending angularly from an inner end of the outer portion to the juncture of the longitudinal fold line at the side of that side wall and the fold line joining that flap to the side wall;

a pair of minor bottom flaps foldably joined to the bottom edges of respective end walls along transverse fold lines, said minor bottom flaps each including a portion lying beneath an adjacent portion of one major bottom flap, and a portion lying above an adjacent portion of the other major bottom flap when the box is erected; and a diagonal fold line extending across one of said extensions of each said major bottom flap, defining a triangular corner panel on a side edge of each major bottom flap between the diagonal fold lines and the side edge and free edge of each major bottom flap, each said triangular corner panel being folded about the diagonal fold line and adhesively attached to a respective adjacent minor bottom flap, wherein the major and minor bottom flaps project externally of the tubular structure when said box is in its folded-flat condition, and when a force is exerted laterally inwardly on opposite longitudinally folded edges of the folded-flat box, the side and end walls open up away from each other and the bottom flaps automatically move into a closed position to form an erected box.

2. A collapsible bulk box as claimed in claim 1, wherein:

the corner panels located at the side of a side wall corresponding to that side adjacent the location of the triangular portions in the major bottom flaps are bisected by a longitudinal corner panel fold line, said longitudinal corner panel fold lines in a pair of diagonally opposite corner panels defining the outer side edges of the folded-flat box.

3. A collapsible bulk box as claimed in claim 2, wherein:

the inner portion of each extension side edge has an angularly shaped outwardly protruding point intermediate its ends, said angularly shaped inner portions lying adjacent the corner panels in an erected box and closing any gaps that might be formed between the bottom and the corner panels in the erected box.

4. A box movable between a flattened condition and an erected condition, and having a bottom structure that automatically moves to a closed position as the box is erected, comprising:

a single blank scored to define a first pair of rectangular panels that form first and second opposed side walls in an erected box, a second pair of rectangular panels that form first and second opposed end walls in an erected box, and at least a third pair of rectangular panels connected between adjacent side and end walls and that form first and second opposed diagonal corner panels in an erected box, said side and end walls and said diagonal corner panels having top and bottom edges;

a longitudinal fold line bisecting each said corner panel, said longitudinal fold lines defining opposite side edges of the box when it is folded flat;

a glue panel extending along one edge of the blank, said blank being folded upon itself along said longitudinal fold lines into a folded-flat condition, and said glue panel adhesively attached to an opposite edge of the blank to form a flattened tubular structure;

a pair of major bottom flaps foldably joined to the bottom edges of respective side walls along transverse fold lines, each major bottom flap having laterally projecting extensions on opposite ends thereof, at least a portion of one extension on each major bottom flap being foldable about a diagonal fold line that is substantially coplanar with the longitudinal fold lines in the corner panels when the box is in its flattened condition;

a pair of minor bottom flaps foldably joined to the bottom edges of respective end walls along transverse fold lines; and a portion of each minor bottom flap secured to said foldable portion of a respective adjacent extension on an adjacent end edge of a major bottom flap so that when the box is folded flat along said longitudinal fold lines the flaps lie flat, and when the box is erected by pressing inwardly against said opposite side edges to cause the side and end walls to open up and move away from one another, the major and minor bottom flaps are automatically moved into a closed position across a bottom end of the erected box.

5. A collapsible octagonal bulk box movable between a flattened condition and an erected condition, and having a bottom structure that automatically moves into closed position when the box is moved into its erected condition, comprising:

a pair of opposed side walls having bottom edges;

a pair of opposed end walls having bottom edges;

opposed pairs of diagonal corner panels connected between adjacent side and end walls, each of the corner panels in a diagonally opposite pair of corner panels being bisected by a longitudinal fold line, said longitudinal fold lines defining opposite side edges of the box when it is in a folded flat condition;

a major bottom flap foldably joined to the bottom edge of each of the side walls, each major bottom flap having a fold line extending across one end thereof, said fold lines delineating one side of a foldable end portion of each major bottom flap;

a minor bottom flap foldably joined to the bottom edge of each of the end walls; and a portion of each minor bottom flap connected to an adjacent said end portion of a respective major bottom flap, and the fold lines in the major bottom flaps being in coplanar relationship with the longitudinal fold lines defining opposite side edges of the box when the box is in its flattened condition, so that the major and minor bottom flaps lie flat when the box is in a flattened condition and so that they automatically move into a position to close the bottom of the box as the box is moved into its erected condition.

* * * * *